US006216504B1

(12) United States Patent
Kurakake et al.

(10) Patent No.: US 6,216,504 B1
(45) Date of Patent: Apr. 17, 2001

(54) TRAVELING SHEET THICKNESS CHANGING METHOD FOR COLD TANDEM ROLLER

(75) Inventors: Hiroshi Kurakake; Hisashi Tsuchida, both of Kurashiki; Yutaka Saito; Satoshi Hattori, both of Hitachi, all of (JP)

(73) Assignees: Kawasaki Steel Corporation, Kobe; Hitachi Ltd., Tokyo, both of (JP)

( * ) Notice: Subject to any disclaimer, the term of this patent is extended or adjusted under 35 U.S.C. 154(b) by 0 days.

(21) Appl. No.: 09/462,811

(22) PCT Filed: Sep. 4, 1998

(86) PCT No.: PCT/JP98/03974

§ 371 Date: Jan. 14, 2000

§ 102(e) Date: Jan. 14, 2000

(87) PCT Pub. No.: WO99/12669

PCT Pub. Date: Mar. 18, 1999

(30) Foreign Application Priority Data

Sep. 5, 1997 (JP) ..... 9-240593

(51) Int. Cl.[7] ..... B21B 37/72

(52) U.S. Cl. ..... 72/8.8; 72/9.2; 72/11.5; 72/11.8; 72/365.2

(58) Field of Search ..... 72/8.6, 8.8, 9.2, 72/10.4, 11.4, 11.5, 11.8, 12.1, 12.3, 12.5, 365.2

(56) References Cited

U.S. PATENT DOCUMENTS 5,809,817 * 9/1998 Ginzburg ..... 72/8.6

FOREIGN PATENT DOCUMENTS 61-78505 4/1986 (JP) .
2-112814 * 4/1990 (JP) ..... 72/9.2
3-285719 * 12/1991 (JP) ..... 72/11.4
6-15318 * 1/1994 (JP) ..... 72/11.8
6-154829 * 6/1994 (JP) ..... 72/8.6
7-88518 4/1995 (JP) .
7-185627 7/1995 (JP) .
8-112608 5/1996 (JP) .

* cited by examiner

*Primary Examiner*—Ed Tolan
(74) *Attorney, Agent, or Firm*—Oliff & Berridge, PLC.

(57) ABSTRACT

Set values of a gauge-alteration-in-rolling amount after the next (i+1)-th stand and subsequent stands are modified, using the rolling results obtained when a leading end of a succeeding material passes through the i-th stand and the gauge results of the leading end portion of the succeeding material detected by the i-th stand outlet side gauge detector. The gauge results of the leading end of the succeeding material on the i-th stand outlet side is tracked up to the (i+1)-th stand, to thereby control the rolling speed of the i-th stand so as to make constant a mass-flow from the leading end of the succeeding material on the (i+1)-th stand inlet side. Thereby, the reverse off gauge caused at the succeeding stand, by turning on the AGC of the preceding stand, can be prevented and the gauge can be controlled to a desired value from the coil leading end portion.

6 Claims, 6 Drawing Sheets

TRAVELING SHEET THICKNESS CHANGING METHOD FOR COLD TANDEM ROLLER

This application is a 371 of PCT/SP98/03974 filed Sep. 4, 1998.

TECHNICAL FIELD

The present invention relates to a gauge-alteration-in-rolling method of, when continuously rolling materials-to-be-rolled by a cold tandem rolling mill, altering set values from for the preceding material to for the succeeding material, and more particularly, to a gauge-alteration-in-rolling method in a cold tandem rolling mill, which is capable of realizing a high accuracy in gauge immediately after the gauge-alteration-in-rolling point passing.

BACKGROUND ART

At the time of the gauge-alteration-in-rolling in the cold tandem rolling mill, generally a gauge-alteration-in-rolling amount (a roll gap-alteration amount and a rolling speed-alteration amount) of each of the stands is calculated in advance, during rolling a preceding material, using an estimated rolling load value and an estimated forward slip value, which are obtained by path schedules of the preceding and the succeeding material, a set value of tension between stands, an estimated deformation resistance value, an estimated friction coefficient value, and the like.

On this occasion, there has been proposed a method of, when detectors for measuring the rolling results are available, modifying the gauge-alteration-in-rolling amount using thus obtained rolling results.

For example, there has been known a method of, when a gauge detector is provided on an inlet side of the rolling mill, modifying the roll gap-alteration amount of a first stand using a mother material gauge measured by the inlet side gauge detector. Also, there has been known a method of, when detectors for measuring the rolling load, the tension between the stands, the rolling speed, and the stand outlet side gauge are disposed at a preceding stand, modifying a gauge-alteration-in-rolling amount at a succeeding stand using the rolling results of the preceding stand detected by these detectors.

These methods intend for modifying, using the rolling results, the setting errors of a gauge-alteration-in-rolling amount which results from various wrong estimation carried out for the materials-to-be-rolled.

However, only modifying the gauge-alteration-in-rolling amount using the measured mother material gauge like the former method disables the setting errors resulting from difference in material property of the materials-to-be-rolled, such as a deformation resistance error, to be modified.

Further, according to the latter method of modifying the gauge-alteration-in-rolling amount of the succeeding stand using the rolling results of the preceding stand, calculating the difference in material property of the material-to-be-rolled by some methods using the rolling results, and then modifying the gauge-alteration-in-rolling amount of the succeeding stand using the above calculated material-wise error causes the leading end portion of the succeeding material to be controlled in gauge deviation, which, however, provides the following problems:

For example, when modifying, between the i-th stand and the next (i+1)-th stand, the gauge-alteration-in-rolling amount of the (i+1)-th stand using the results of the i-th stand, the gauge of the leading end portion of the succeeding material exposed at the (i+1)-th stand gets nearer to a desired value as shown by the arrow A in FIG. 7. However, when an AGC (automatic gauge control) of the i-th stand is turned on after the gauge-alteration-in-rolling point B passes through the i-th stand, and hence the gauge deviation, resulting from the wrong setting at the time of the gauge-alteration-in-rolling at the i-th stand, gets nearer to a desired value as shown by the arrow C, the (i+1)-th stand outlet side gauge, which should get nearer to the desired value as shown by the arrow D unless there were no modification, shown by the arrow A, due to the rolling results of the i-th stand, comes off adversely from the leading end portion, as shown by the arrow E, due to the modification shown by the arrow A. This, until the AGC of the (i+1)-th stand is turned on and hence the (i+1)-th stand outlet side gauge returns to the desired value as shown by the arrow F, reversely increases the gauge deviation, which undesirably provides the off gauge.

DISCLOSURE OF THE INVENTION

The present invention has been made in order to solve the above-mentioned prior art problems. It is therefore an object of the invention to realize a high accuracy in gauge immediately after the gauge-alteration-in-rolling point passing.

The present invention provides a gauge-alteration-in-rolling method of altering, when continuously rolling materials-to-be-rolled by the cold tandem rolling mill, altering set values from for a preceding material to for a succeeding material, characterized in that modifying, using the rolling result (a rolling load, a stand inlet and a stand outlet side tension, a rolling speed, etc.) obtained when a leading end portion of the succeeding material passes through the i-th stand and the gauge results of the leading end portion of the succeeding material detected by the i-th stand outlet side gauge detector, set values of a gauge-alteration-in-rolling amount at the next (i+1)-th stand and subsequent stands (a roll gap-alteration amount and a rolling speed-alteration amount); and tracking the gauge results of the leading end portion of the succeeding material on the i-th stand outlet side up to the (i+1)-th stand, to thereby control the rolling speed at the i-th stand so as to make constant a mass-flow from the leading end portion of the succeeding material on the (i+1)-th stand inlet side. This enables the above-mentioned problem to be solved.

BEST MODE FOR CONDUCTING THE INVENTION

An embodiment of the present invention will be described hereinafter with reference to the drawings.

Figure 1:
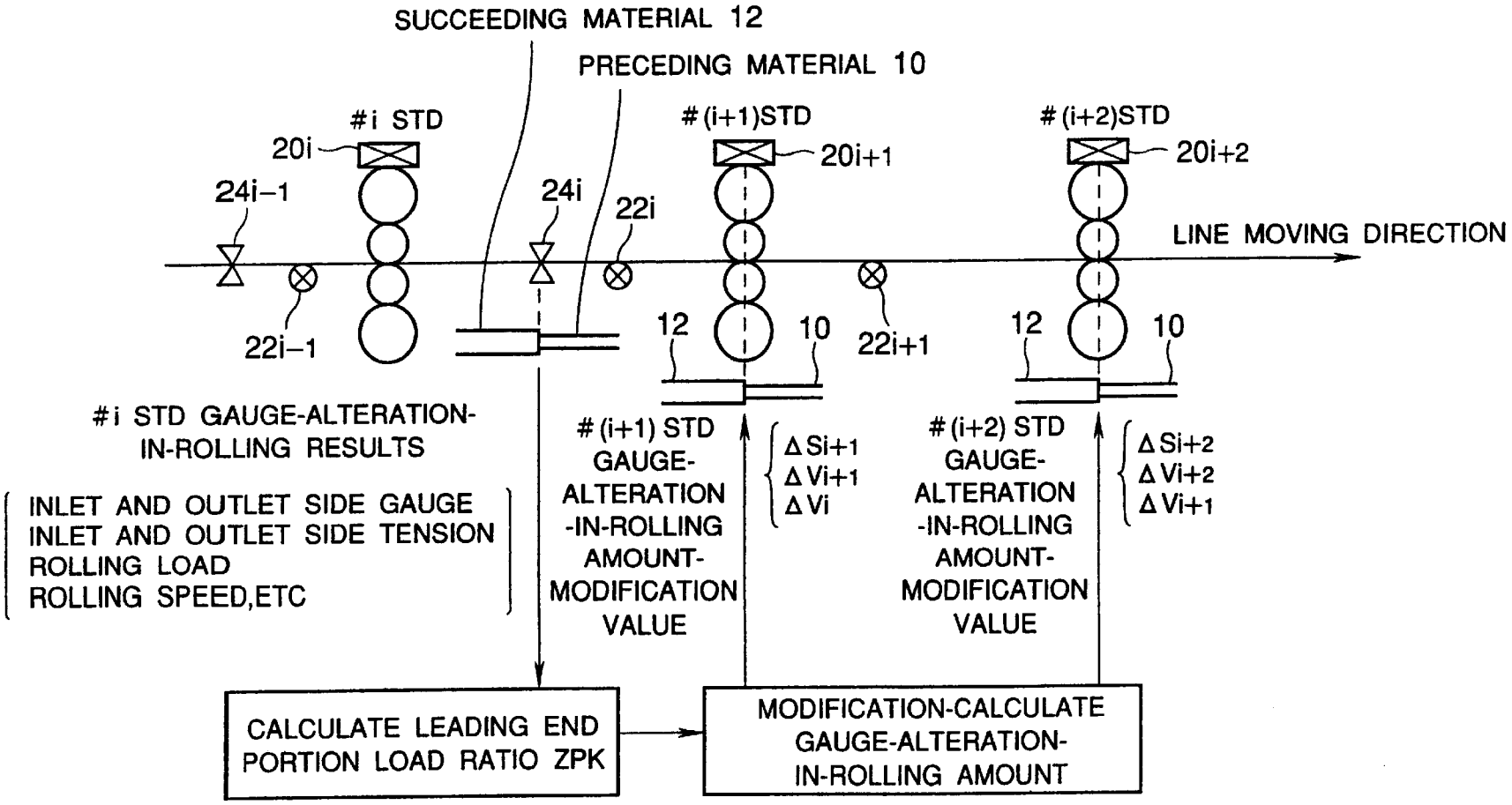
FIG. 1 is a block diagram showing a method of modifying a gauge-alteration-in-rolling amount using rolling results, which is proposed in Japanese Patent Application No. Hei 8-143066 by the applicant.

In an embodiment of the present invention as shown by the FIG. 1, when a leading end portion of a succeeding material 12 is gripped into the i-th stand, detectors such as a load detector 20*i* and a tension detector 22*i* of the i-th stand collect rolling load results, a stand inlet and outlet side tension results, rolling speed results, and the like, and also collect gauge results obtained when the result collecting point reaches an gauge detector 24*i* on the i-th stand outlet side. Then, a load ratio Zpk of the leading end portion of the succeeding material is learned as a learning coefficient by the use of the following equation:

$$Zpk=Pact/Pcal \quad (1)$$

where Pact is a rolling load result value of the i-th stand, and Pcal is a calculated value of a rolling load obtained by the use of a rolling load equation according to the tension, the speed, the gauge results, and the like.

Supposing that the influence of the change of the friction coefficient for the coil leading end portion on the rolling load is small, the learning coefficient Zpk is used as an index representing an estimated deformation resistance error of the material. Namely, the above-mentioned learning coefficient Zpk obtained by the use of the equation (1) at the i-th stand is multiplied to a succeeding material load-estimating equation of the (i+1)-th stand and subsequent stands, so as to modify a set value of the gauge-alteration-in-rolling amount of the (i+1)-th stand and subsequent stands (e.g. a roll gap amount ΔSi+1, ΔSi+2, and a rolling speed-alteration amount ΔVi+1, ΔVi+2), and then the obtained value is output to a control device.

In FIG. 1, reference numeral 10 designates a preceding material, 24*i* 1 a gauge detector on the i-th stand inlet side, 22*i* 1 a tension detector on the i-th stand inlet side, 20*i+1 a load detector on the (i*+1)-th stand, 20*i+2 a load detector on the (i*+2)-th stand, and 22*i*+1 a tension detector on the (i+1)-th stand outlet side.

The above-mentioned gauge-alteration-in-rolling amount modification-calculation, which has been proposed in Japanese Patent Application No. Hei 8-143066 by the applicant, is preferably carried out on all the downstream side stands, since it reflects the hardness of the strip.

Figure 7:
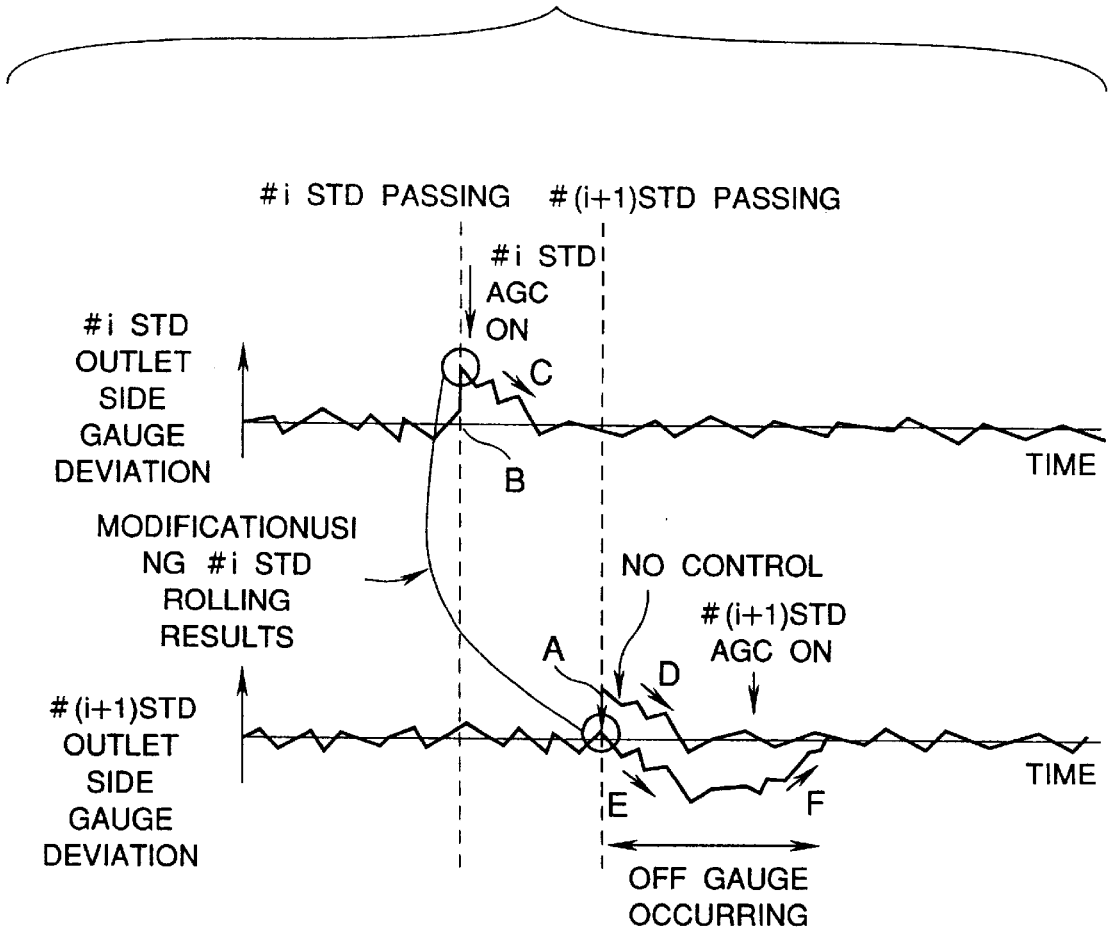
FIG. 7 is a diagrammatic drawing useful in explaining the problem occurring on the conventional gauge-alteration-in-rolling method.

On the other hand, according to the above method, although the gauge-alteration-in-rolling amount re-calculation using the results makes the gauge of the leading end portion of the succeeding material at the (i+1)-th stand into a desired value as described with reference to FIG. 7, until the AGC of the (i+1)-th stand is turned on after the AGC of the i-th stand has been turned on, the off gauge reversely occurs at the (i+1)-th stand outlet side as described above.

Figure 2:
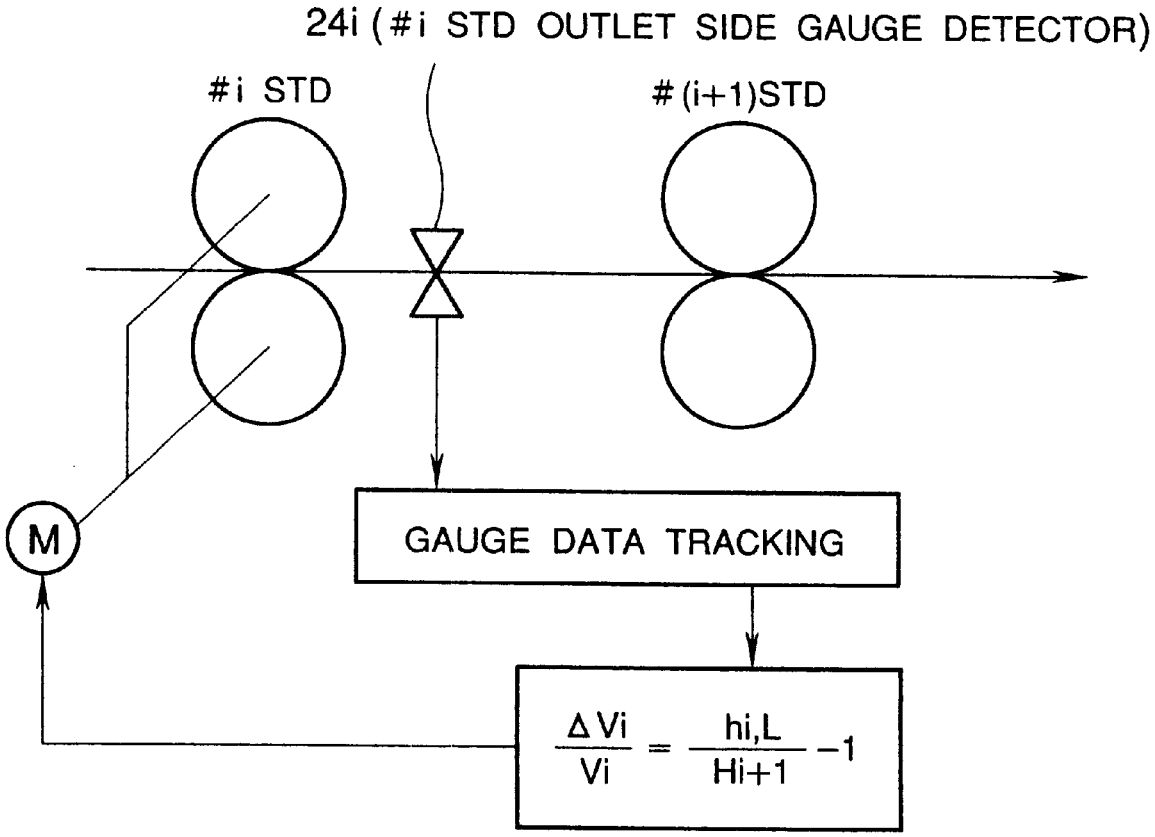
FIG. 2 is a block diagram showing a state in which a leading end mass-flow-constant control is carried out according to the present invention.

Therefore, in order to solve the problem, according to the present invention, as shown in FIG. 2, the i-th stand outlet side gauge results of the leading end portion of the succeeding material detected at the gauge detector 24*i* on the stand outlet side is locked on when they are collected for the purpose of the gauge-alteration-in-rolling amount re-calculation, and then the gauge results obtained after the results have been collected are tracked up to the (i+1)-th stand. Then, when the tracking point reaches the (i+1)-th stand, the rolling speed Vi of the i-th stand is controlled so as to make constant a mass-flow from the coil leading end portion (lock-on point) on the (i+1)-th stand inlet side, as shown in the following equation:

$$\Delta Vi/Vi=(hi,L/Hi+1)-1 \quad (2)$$

where ΔVi/Vi designates a rolling speed-alteration amount of the i-th stand, hi,L a lock-on value of the i-th stand outlet side gauge result of the coil leading end portion, Hi+1 a value of the (i+1)-th stand inlet side gauge results obtained by tracking the output of the gauge detector on the i-th stand outlet side 24*i* up to the (i+1)-th stand.

In FIG. 2, M designates a mill motor of the i-th stand.

A control in FIG. 2 (referred to as "the leading end portion mass-flow-constant control") is carried out until the gauge-alteration-in-rolling is finished and then each of the AGC starts controlling. The leading end portion mass-flow-constant control is for eliminating the gauge deviation, which requires the control by only a single stand just thereunder.

In this way, the wrong setting of the gauge-alteration-in-rolling amount at the time of the gauge-alteration-in-rolling can be modified using the rolling results by modification-calculating the gauge-alteration-in-rolling amount which is the same as Japanese Patent Application No. Hei 8-143066, and the off gauge occurring by the AGC turning on at the preceding stand is prevented at the next stand by the leading end portion mass-flow-constant control characterizing the present invention, which enables the gauge to be controlled to a desired value from the coil leading end portion.

Figure 3:
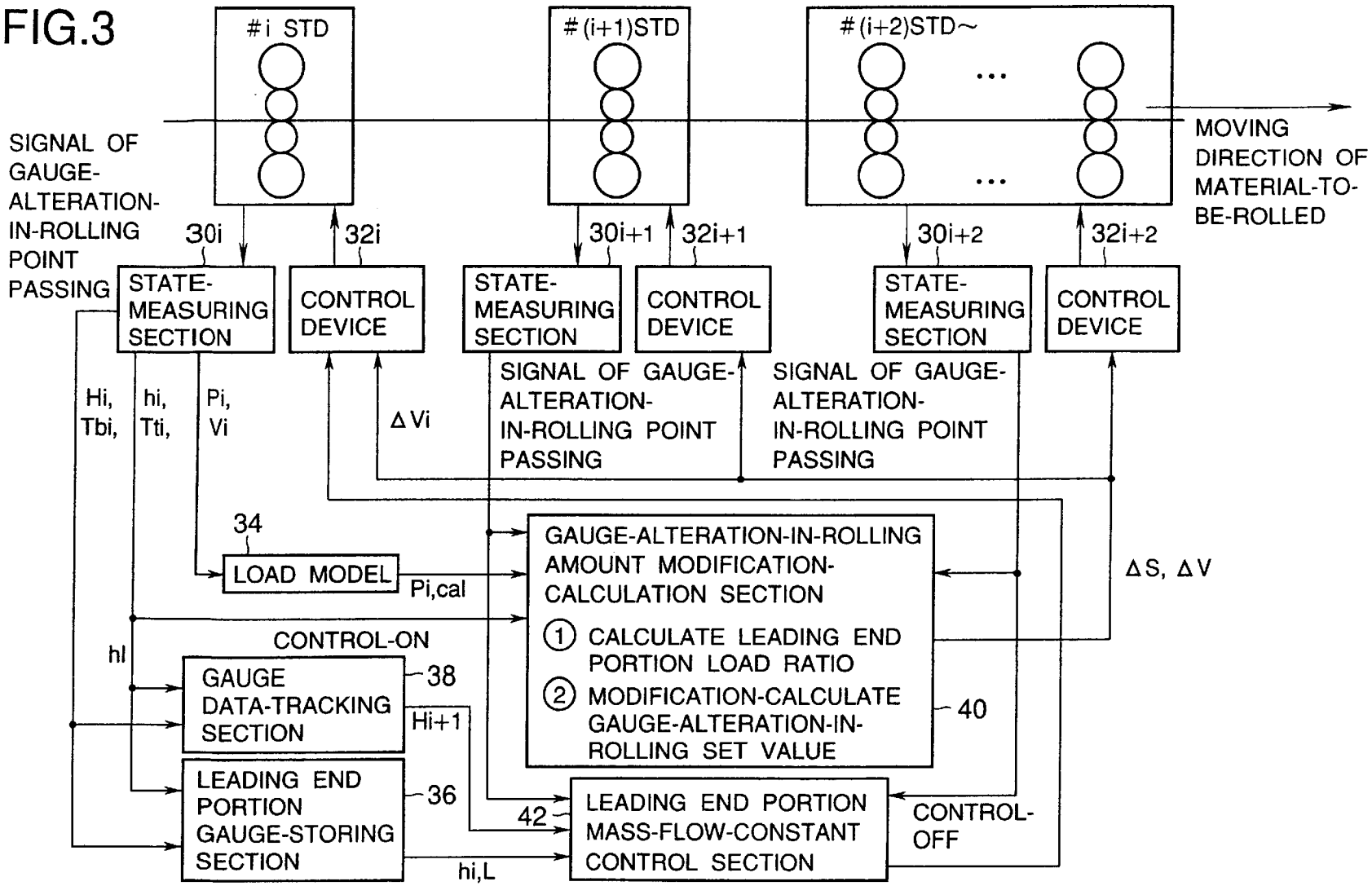
FIG. 3 is a block diagram showing an arrangement of a control device, according to an embodiment, for carrying out the present invention.

Referring now to FIG. 3, there is shown an embodiment of a control device for carrying out the present invention. This embodiment comprises a state-measuring section 30*i*, 30*i*+1, 30*i*+2, . . . , and a control device 32*i*, 32*i*+1, 32*i*+2, . . . for each of the stands.

A load model 34 receives state signals, such as an inlet gauge Hi, an outlet gauge hi, a rolling load Pi, a backward tension Tbi, a forward tension Tfi, a rolling speed Vi, which are obtained by the state-measuring section 30*i*, and then calculates a rolling load Pi,cal by the use of a rolling load equation.

Also, a signal of the gauge-alteration-in-rolling point passing through the i-th stand, which is obtained by the state-measuring section 30*i*, causes the then outlet gauge hi to be stored in a leading end portion gauge-storing section 36, and then to be tracked at a gauge data-tracking section 38.

A load-calculated value Pi,cal obtained by the load model 34, and a load result value Pi,act obtained at the state-measuring section 30*i* are input to a gauge-alteration-in-rolling amount modification-calculating section 40, which calculates the leading end portion load ratio Zpk by the use of the equation (1), and then calculates the set values of the gauge-alteration-in-rolling modification amount ΔS, ΔV (in the same as Japanese Patent Application No. Hei 8-143066).

Furthermore, a leading end portion mass-flow-constant control section 42 for carrying out the leading end portion mass-flow-constant control, which characterizes the present invention, is turned on when the gauge-alteration-in-rolling point passes through the (i+1)-th stand, and then calculates the i-th stand roll speed modification amount ΔVi by the use of the above-mentioned equation (2) according to the leading end portion the i-th stand outlet gauge result lock-on value hi,L input from the leading end portion gauge storing section 36, and the (i+1)-th stand inlet gauge result value Hi+1, obtained by tracking the i-th stand outlet result value hi, input from the gauge data-tracking section 38. The calculated value is output to the control device 32*i* of the i-th stand mill motor and so on.

The control by the leading end portion mass-flow-constant control section 42 is turned off by the signal transmitted from e.g. the state-measuring section 30*i*+2, at the timing (variable) when the AGC control of the (i+1)-th stand is turned on.

According to the embodiment, the method of the present invention is applied to the first stand in a five-stand-type continuous rolling mill, thereby causing the gauge-alteration-in-rolling amount of the second stand and subsequent stands to be corrected.

Figure 4:
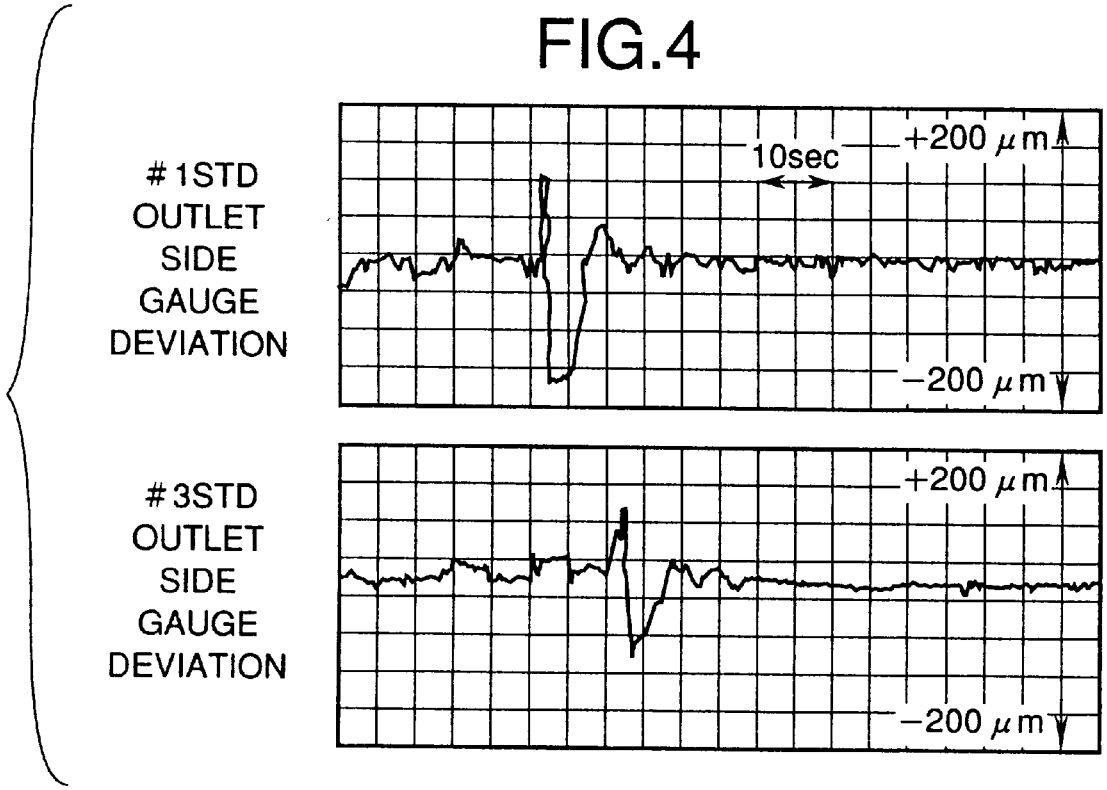
FIG. 4 is a diagrammatic drawing showing a change state of the outlet side gauge deviation at the time of the gauge-alteration-in-rolling when the gauge-alteration-in-rolling is performed by the conventional method.
Figure 5:
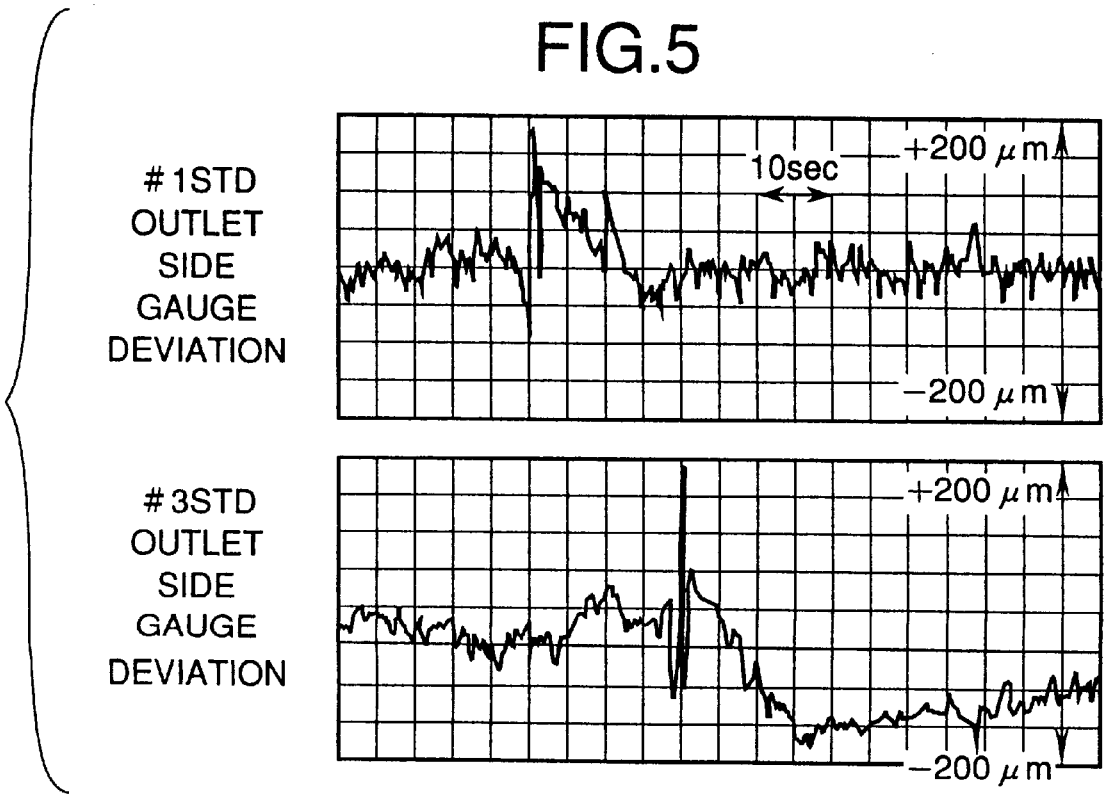
FIG. 5 is a diagrammatic drawing showing an example of a change state of the outlet side gauge deviation at the time of the gauge-alteration-in-rolling when the calculation to modify the gauge-alteration-in-rolling amount proposed in Japanese Patent Application No. Hei 8-143066 is performed.
Figure 6:
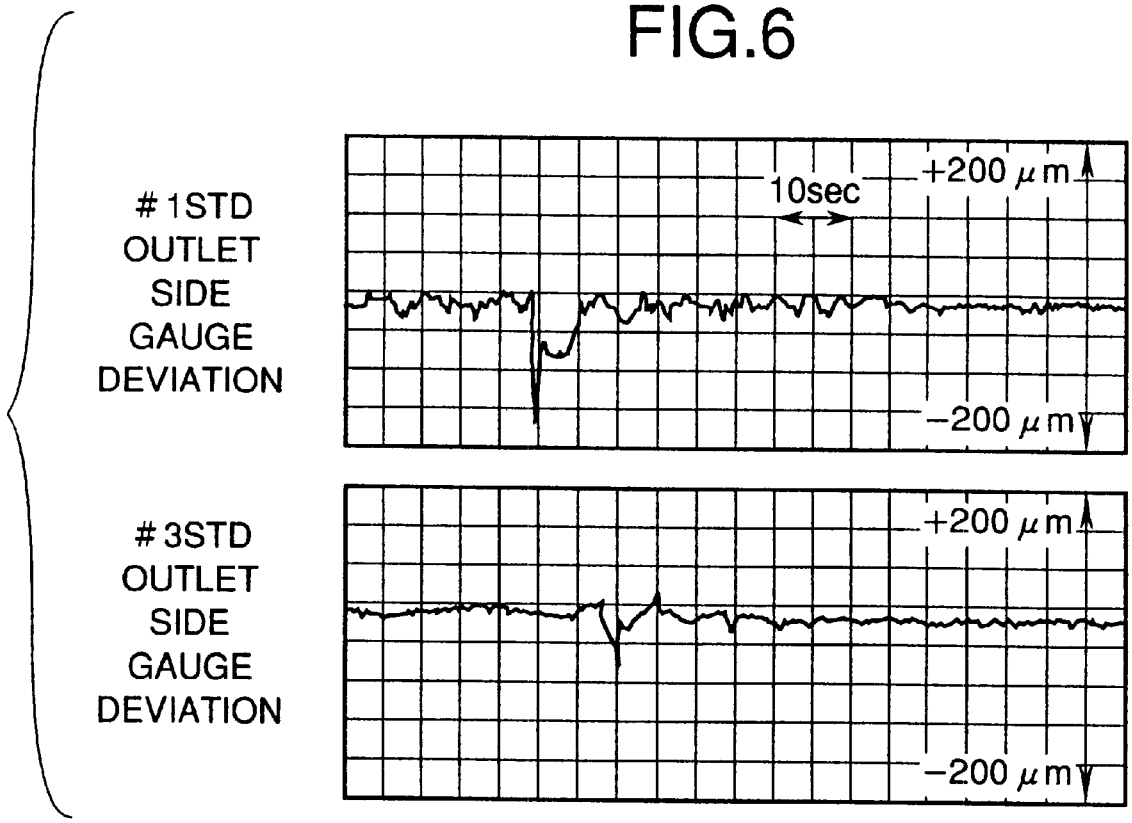
FIG. 6 is a diagrammatic drawing showing an example of a change state of the outlet side gauge deviation at the time of the gauge-alteration-in-rolling when the present invention is carried out.

There is shown in FIG. 4 a change state of the deviation of the first stand outlet gauge and the third stand one (in place of the second stand outlet gauge detector which is not provided) in the case of the gauge-alteration-in-rolling according to a conventional gauge-alteration-in-rolling method (referred to as "the conventional method") which carries out no gauge-alteration-in-rolling modification-calculation using the rolling results. There is shown in FIG. 5 a change state in which the rolling speed modification using the equation (2) is not carried out although the gauge-alteration-in-rolling amount of the next stand and subsequent stands are modified using the rolling results as is the case with the former application (referred to as "the comparison method"). There is shown in FIG. 6 a case in which the gauge-alteration-in-rolling is carried out according to the method of the present invention.

As apparent from FIG. 4, according to the conventional method, the gauge deviation occurring on the first stand remains up to the third stand. Also, according to the comparison method, the gauge deviation of the coil leading end portion occurring on the first stand due the wrong setting of the gauge-alteration-in-rolling amount is modified at the second stand; however, the AGC of the first stand is turned on, and then as the first stand outlet side gauge gets nearer to the desired value, the gauge deviation reversely increases at the third stand. Over against these, according to the present invention, as apparent from FIG. 6, the coil leading end portion gauge becomes a desired value at the second stand, and then the second stand outlet gauge is controlled by the use of the equation (2), which enables the gauge to be controlled to the desired value from the coil leading end portion.

CAPABILITY OF EXPLOITATION IN INDUSTRY

The reverse off gauge which occurs when the AGC of the preceding stand is turned on, is prevented from occurring on the succeeding stand, which enables the gauge to be controlled to the desired value from the coil leading end portion.

What is claimed is:

1. A method of altering settings for gauge-alteration-in-rolling amounts from set values for a preceding material to set values for a succeeding material when continuously rolling materials in a cold tandem rolling mill, comprising:

obtaining rolling results for a succeeding material when a leading end portion of the succeeding material passes through an i-th stand and gauge results when the leading end portion of the succeeding material passes through a gauge detector at an outlet side of the i-th stand;

modifying settings for a gauge-in-alteration-rolling mount at an (i+1)-th stand and subsequent stands, using the rolling results obtained when the leading end portion of the succeeding material passes through the i-th stand and using gauge results of the leading end portion of the succeeding material detected by the gauge detector at the outlet side of the i-th stand; and tracking the gauge results for the leading end portion of the succeeding material from the gauge detector at the outlet side of the i-th stand to an inlet side of the (i+1)-th stand, to thereby control the rolling speed at the i-th stand and make constant a mass-flow from the leading end portion of said succeeding material on the inlet side of the (i+1)-th stand.

2. A method of altering settings for gauge-alteration-in-rolling amounts, as set forth in claim 1, wherein the rolling results obtained when the leading end portion of the succeeding material passes through the i-th stand include at least one of a rolling load, a tension at an inlet side of a stand and a tension at an outlet side of a stand, and a rolling speed.

3. A method of altering settings for gauge-alteration-in-rolling amounts, as set forth in claim 1, wherein a setting of the gauge-alteration-in-rolling amount at the (i+1)-th stand and the subsequent stands includes at least one of a roll gap-alteration amount and a rolling speed-alteration amount.

4. A method of altering settings for gauge-alteration-in-rolling amounts, as set forth in claim 3, wherein the setting for the gauge-alteration-in-rolling amount is calculated, during rolling of a preceding material, using an estimated rolling load and an estimated forward slip value obtained by path schedules of the preceding material and the succeeding material, a setting for tension between stands, an estimated deformation resistance value, and an estimated friction coefficient.

5. A method of altering settings for gauge-alteration-in-rolling amounts, as set forth in claim 1, wherein the settings for the gauge-alteration-in-rolling amount at the (i+1)-th stand and the subsequent stands is modified by:

learning a load ratio, Pact/Pcal, where Pact is a rolling load measured at the i-th stand and Pcal is a calculated value of a rolling load obtained by the use of a rolling load equation, for the leading end portion of the succeeding material as a learning coefficient using the rolling results and the gauge results at the outlet side of the i-th stand; and multiplying a load-estimating equation for the succeeding material at the (i+1)-th stand and the subsequent stands by the learning coefficient obtained at the i-th stand as an index representing an estimated deformation resistance error of the material.

6. A method of altering settings for gauge-alteration-in-rolling amounts, as set forth in claim 1, wherein a control to keep mass flow constant from the leading end portion of the succeeding material is maintained until the gauge-alteration-in-rolling is finished and an automatic gauge control is started at the (i+1)-th stand.

* * * * *

UNITED STATES PATENT AND TRADEMARK OFFICE

CERTIFICATE OF CORRECTION

PATENT NO. : 6,216,504 B1
DATED : December 7, 2001
INVENTOR(S) : Hiroshi Kurakake et al.

It is certified that error appears in the above-identified patent and that said Letters Patent is hereby corrected as shown below:

Please correct the written description as follows:

Column 3,
Line 46, please replace "24i 1" with -- 24i-1 --,
Line 47, please replace "22i 1 with -- 22i-1 --, Signed and Sealed this Twenty-sixth Day of March, 2002

*Attest:*

*Attesting Officer*

JAMES E. ROGAN
*Director of the United States Patent and Trademark Office*